United States Patent [19]

Bos

[11] 4,322,898

[45] Apr. 6, 1982

[54] CUTTER HEAD WITH ADJUSTABLE SUCTION NOZZLE

[75] Inventor: Wouter A. Bos, Av Dordrecht, Netherlands

[73] Assignee: Reba B.V., Wolwevershaven, Netherlands

[21] Appl. No.: 152,412

[22] Filed: May 22, 1980

Related U.S. Application Data

[63] Continuation-in-part of Ser. No. 37,520, May 11, 1978, abandoned.

[30] Foreign Application Priority Data

May 11, 1978 [NL] Netherlands ..... 7805116

[51] Int. Cl.[3] ..... E02F 3/92

[52] U.S. Cl. ..... 37/64

[58] Field of Search ..... 37/64, 65, 66, 67

[56] References Cited

U.S. PATENT DOCUMENTS

| | | | |
|---|---|---|---|
| 222,380 | 12/1879 | Chaguette | 37/67 |
| 331,861 | 12/1885 | Bolles | 37/67 |
| 365,140 | 6/1887 | Lynch | 37/67 |
| 369,976 | 9/1887 | Angell | 37/67 |
| 725,817 | 4/1903 | Bates | 37/67 |
| 3,253,357 | 5/1966 | Allard | 37/65 |
| 3,885,330 | 5/1975 | Araoka | 37/64 X |

FOREIGN PATENT DOCUMENTS

| | | | |
|---|---|---|---|
| 1484786 | 6/1969 | Fed. Rep. of Germany | 37/65 |
| 546721 | 3/1977 | U.S.S.R. | 37/66 |

*Primary Examiner*—Clifford D. Crowder

*Attorney, Agent, or Firm*—Scully, Scott, Murphy & Presser

[57] ABSTRACT

A cutter head for a cutter dredger, which cutter head has a disc-like configuration with a bottom plate being rotatable and carrying a row of blades adjacent the circumference. The soil loosened by the blades, whether or not aided by the bottom plate, is transported to a suction nozzle arranged in scooping relationship within the row of blades, which nozzle may be fitted with an attachment adapted to bring the effective suction nozzle opening to adjacent the soil loosening location.

4 Claims, 7 Drawing Figures

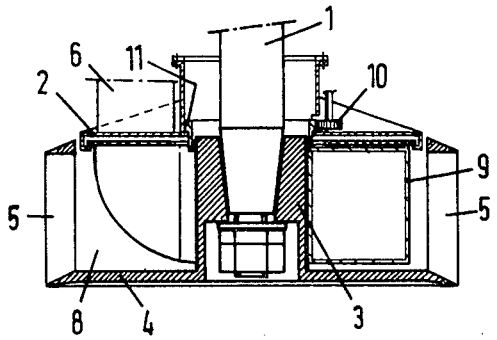
FIG. 1
FIG. 2a
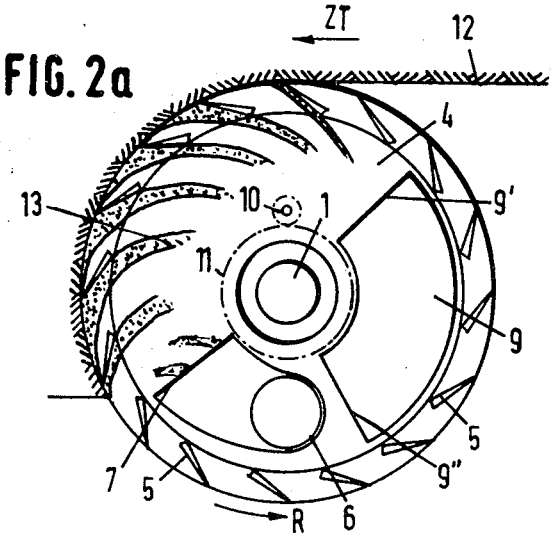
FIG. 2b
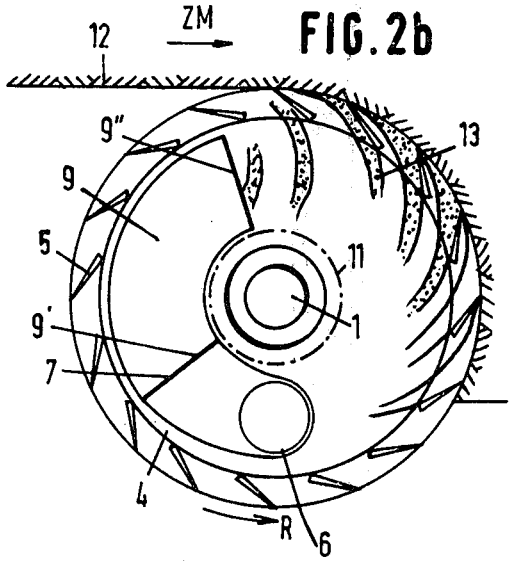

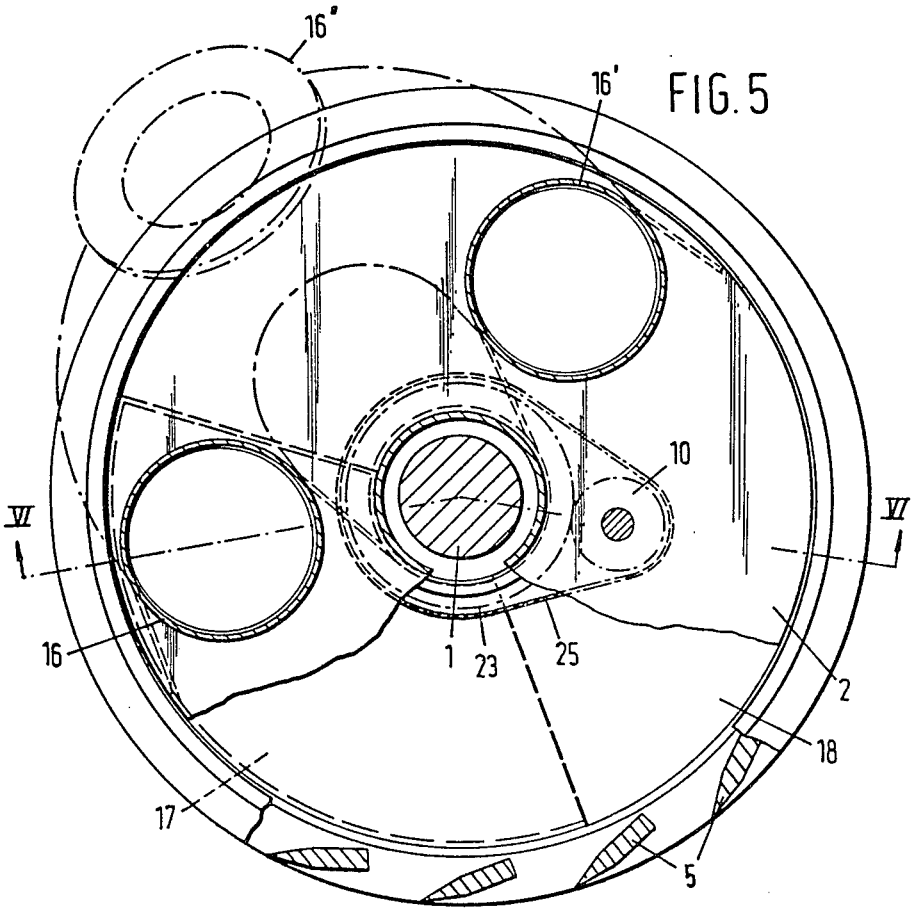
FIG. 5
FIG. 6
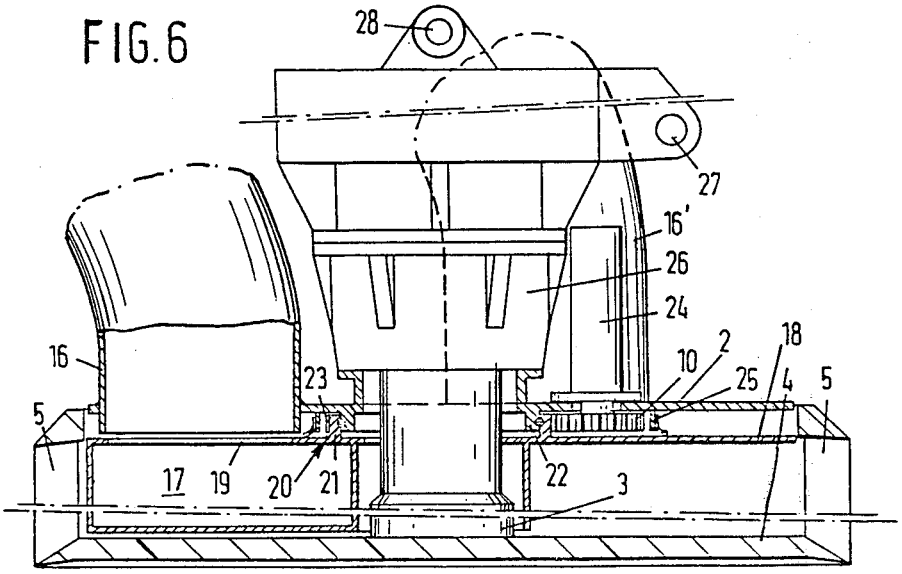

CUTTER HEAD WITH ADJUSTABLE SUCTION NOZZLE

CROSS REFERENCE TO RELATED APPLICATIONS

This application is a continuation-in-part application of Ser. No. 037,520 for A Cutter Head With Adjustable Suction Nozzle, filed May 11, 1978, now abandoned.

BACKGROUND OF THE INVENTION

The present invention relates to a cutter head for a suction dredger provided with a row of blades extending substantially in a cylindrical surface, which row of blades is rotatable about a central tilting shaft.

Such a cutter head for a free-sailing trailing dredger is described in Dutch Pat. No. 124,103, wherein the blades are mounted at right angles to a superimposed carrier ring and a pair of such cutter heads, each having its own driving gear, is secured to the arm pivoting up and down relative to the vessel. By varying the rotation speed and rotation direction of the two cutter heads, there may be achieved an orienting effect on the vessel and hauling ropes or the like.

Cutter heads controlling means may be omitted. The soil loosened by the cutter heads is discharged as a mixture with water by means of a dredge pump and via a suction conduit, the inlet nozzle of which lies at the level of the carrier ring.

Through the tiltability of the axis of rotation of the row of blades, it is possible with such cutter heads, irrespective of the angle of inclination of the ladder, that the row of blades may be fixed in any required position, e.g. horizontally, so with vertical axis of rotation, in which case a horizontal bottom may be delivered.

A drawback going with such prior art, disc-shaped cutter heads, indeed all prior art rotary cutter heads, even that of the crown type, is the inadequate formation of a properly suctionable mixture of the loosened soil and the transport water. As a result thereof spillage occurs, the definition of spillage being soil that is cut loose but which does not arrive in the suction tube. The mixture formation in prior art cutter heads is inadequate, since the transport of the loosened material to the suction nozzle, i.e. the inlet of the suction line, has to be done exclusively by the under-pressure in the suction nozzle and this rapidly decreases with increasing distance to the suction nozzle. It is clear that upon increasing dimensions of the cutter heads and consequently increasing distance from the loosening place to the suction nozzle, likewise the quantity of spillage increases.

It is the object of the present invention to avoid this drawback.

To this effect according to the invention there is disposed a closed bottom plate at the lower end of the blades, a suction nozzle being arranged in scooping relationship within the space defined by the row of blades, which means that the face of the suction nozzle lies approximately in a radial plane and the bottom plate being rotatable in the direction of the suction nozzle. Radial plane is intended to mean a plane which extends in a radial direction and includes the axis of rotation of the cutter head in that plane.

Soil loosened by the blades in the suction head according to the invention is brought within the cutter head through the bottom plate in the direction of the suction nozzle, so the transport of the mixture to the suction nozzle no longer depends exclusively on the under-pressure in the suction nozzle. By the specific arrangement of the suction nozzle, moreover the transport distance can be minimized, while the loosened soil need no longer be conducted upwardly to the suction nozzle.

Preferably the blades are secured to the bottom plate and are driven via the bottom plate. As a result a stationary suction nozzle may be arranged within the rotating row of blades in a constructively simple manner.

In a cutter dredger of the type wherein a ladder with a cutter head at the lower end is brought in a swinging movement by means of hauling winches and after each swing the vessel is hauled, so that the cutter head executes substantially concentric dredging cuts, excavation will take place alternately "concurrently" and "counter-currently" upon rotation of the row of blades in one direction, depending on the swinging direction of the ladder. By counter-current, counter-rotating or counter-cutting suction dredging is meant that, seen in top view, the rotation direction of the row of blades at the front side is identically directed to the swinging direction of the ladder. In case of concurrent suction dredging, these directions are opposite.

Since in case of concurrent suction dredging the soil is loosened in another zone of the circumference of the cutter head than in case of counter-current suction dredging, in case of a stationary suction nozzle, the transport distance of the loosened soil as far as the suction nozzle will be different in these two cases.

Consequently, in a preferred embodiment of the invention, the cutter head may be fitted with an attachment in the form of a bent tube disposed concentrically within the row of blades, and which is open on either side and pivotable between a position wherein one tube end adjoins the suction nozzle and a position spaced apart from the suction nozzle.

The attachment therefore constitutes as it were an adaptor or an extension piece of the suction tube with which the suction nozzle can be brought adjacent the place where the soil is loosened at a given swinging direction of the ladder, while the position of the stationary suction nozzle is so chosen that this, during the swinging of the ladder, is present in the other direction, directly downstream of the soil loosening zone.

Thus, a very short suction path can be guaranteed under all circumstances, which path moreover is only horizontal and whereby in conjunction with the closed bottom plate, very high soil concentrations in the suction mixture are possible.

For example in thick mud the tubular adaptor avoids loosened material to be uncontrollably diluted by inflowing water which would adversely affect suction efficiency.

Instead of a curved tubular and pivotable adaptor, a shield extending along the inner side of the row of blades, which shield is pivotable between a position with one end adjacent the suction nozzle opening and a position spaced thereof, can have the same effect. In the position of the shield adjacent the suction nozzle, the material will move through an annular space defined by said shield, the rotary bottom plate, the upper wall and the central sleeve.

The adaptors referred to above, whether they are of the curved tubular type or of the curved shield type are displaceable to and from the suction nozzle opening which is stationary within the row of blades and the adaptors have the effect of displacing the effective suction nozzle opening in such a way that said opening is always positioned close to the area where soil material is loosened by the row of blades.

It is however also possible to position the suction nozzle opening in different areas within the suction head without making use of any adaptors or other auxiliary means, but by moving the suction nozzle itself. Because the suction nozzle must communicate on an upwardly transporting suction line, said suction line must be branched above the suction head and be connected thereto in two different places, wherein the suction nozzle is moveable from each one of said connections to the other. To prevent that when the suction nozzle is positioned under one of said connections, water is sucked in through the other connection, which obviously is undesirable. According to the invention the suction nozzle is mounted on a plate, which apart from a passage for loosened soil through the suction nozzle to the relevant suction line branch, is fully closed. The plate is pivotable together with the suction nozzle and is arranged below the upper wall of the cutter head. Accordingly whenever the suction nozzle is under one of the two suction line connections the other is automatically closed off.

One embodiment of the cutter head with adjustable suction nozzle will be described now, by way of example, with reference to the accompanying drawing, wherein FIG. 1 is an axial cross-section of the suction head and FIG. 2 is an diagrammatic top view of two working situations of the suction head, with FIG. 2*a* illustrating a counter-cutting operation and FIG. 2*b* showing a co-cutting operation;

FIG. 5 is a top view of a second alternative embodiment of the cutter head; and FIG. 6 is a sectional elevational view along line VI—VI in FIG. 5.

Figure 3:
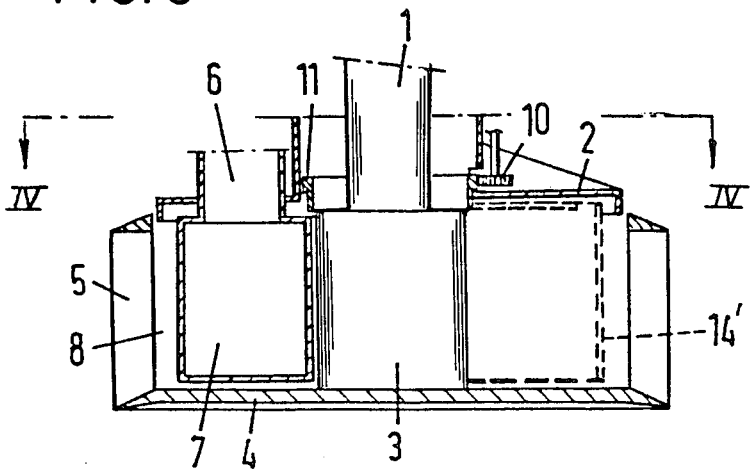
FIG. 3 is an elevational sectional view of an alternative embodiment of the rotary cutter head.

Referring to the drawings, FIGS. 1 and 2 illustrate a first embodiment of the cutter head wherein a drive shaft 1 projects centrally through an at least non-co-rotating upper wall 2 which is stationary relative to a ladder, not shown, of a cutter dredger. The drive shaft 1 is connected via sleeve 3 to a bottom plate 4, at the circumference of which there is arranged a plurality of blades 5 in a row. The row of blades 5 is thus driven in rotation via bottom plate 4 by the drive shaft 1. Through the upper wall 2 extends the end of a suction line 6, the inlet or suction nozzle 7 of which is arranged within the annular space, in scooping relationship, defined by the blades 5 and the sleeve 3, i.e. extending substantially in a plane through the axis of the drive shaft 1. In the annular space indicated by numeral 8 in FIG. 1 there is moreover provided a tubular attachment 9 which is moveable between two positions and the function of which will be further explained with reference to FIGS. 2*a* and 2*b*. For displacing the attachment 9 within the space 8 various techniques may be utilized which per se do not form part of the invention. Exclusively for the sake of illustration the drawing indicates a pinion 10, in engagement with a gear 11 which is connected to the attachment 9.

FIG. 2 shows a working front by 12, the rotation direction of the cutter head by R and the direction of sweep, so the lateral displacement direction of the cutter head by arrows ZT, respectively ZM.

FIG. 2*a* shows the counter-cutting dredging, whereby therefore in situ of the front 12, in top view, the rotation direction R coincides with the direction of sweep ZT and FIG. 2*b* is shown the situation in case of co-cutting dredging in top view.

In the depicted embodiment the bottom plate 4 is integral with the row of blades 5, however separate rotation would also be possible.

In the top view of FIG. 2*a* the left-hand top quadrant of the cutter head is the zone wherein cutting takes place. The loosened pieces of soil 13 fall on the bottom plate 4 and are transported in the direction of the suction nozzle 7 by said plate in conjuction with underpressure produced in the suction line 6, said nozzle being arranged directly downstream of the cutting zone.

With said stationary arrangement of the suction nozzle 7 and with the rotation direction of bottom plate 4 and blades 5 in the direction R, the suction nozzle 7, in case of co-cutting dredging (FIG. 2*b*), will be present at a comparatively large distance from the cutting zone, in this case the right-hand top quadrant of the cutter head. According to the invention, in case of co-cutting dredging, the attachment 9, which has substantially a radial dimension of 90°, is pivoted to the left through about 180°, until the attachment 9 with the end 9' adjoins the suction nozzle 7. The other end 9'', which like the end 9' is open, then serves as suction nozzle and also in the situation shown in FIG. 2*b*, the suction nozzle 9'' is disposed directly downstream of the zone wherein pieces of soil 13 are loosened.

In the cutter head according to the invention consequently, both in case of co-cutting and in case of counter-cutting dredging, there is a minimal distance from the place where soil is being loosened as far as the suction nozzle and the loosened soil is urged in the direction of the suction nozzle through coaction of underpressure in the suction nozzle and the thrust of the bottom plate 4, while the loosened soil is displaced exclusively horizontally.

Figure 4:
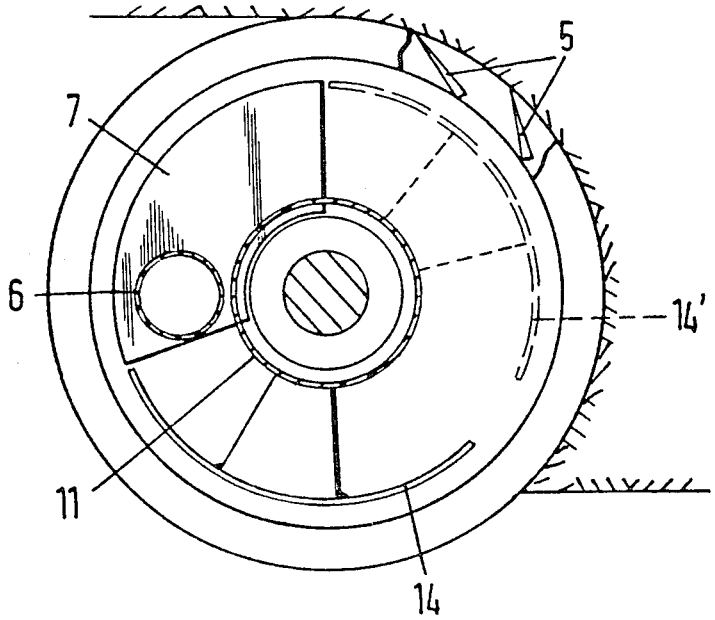
FIG. 4 is an elevational view along line IV—IV in FIG. 3.

In an alternative embodiment according to FIGS. 3 and 4, the tubular adaptor is replaced by a shield which extends along the inner side of the row of blades 5 and is displaceable between the position indicated with drawn lines 14 and the position indicated with broken lines 14', according to the positions of the tubular adaptor 9 in FIGS. 2*a* and 2*b* respectively.

The alternative embodiment according to FIGS. 5 and 6 distinguishes from the embodiments according to FIGS. 1 and 2 and also FIGS. 3 and 4, by the lack of moving auxiliary equipment and by a suction nozzle which is not stationary but which suction nozzle 17, every time during switching from concurrently dredging to counter-currently dredging and vice versa, is effectively displaced as a whole. In FIG. 5 two suction line ends 16 and 16' are depicted, which as indicated with dash dotted lines converge to a connecting flange 16'' for a common suction line. Where each of the suction line branches 16 and 16' ends, the upper wall 2 is provided with a passage and when the suction nozzle 17 finds itself at one of the ends 16, 16', the other end must be closed. According to the invention this is done in a simple way by means of a plate 18 with one opening 19 where the nozzle 17 is connected to said plate 18. Communication between the nozzle 17 and the branches 16, 16' take place through this passage. Except for the passage 19 the plate 18 is closed. The plate 18 and therefore also the suction nozzle 17 connected thereto, is pivotally arranged under the upper wall 2 by means of a pivot bearing 20. The bearing 20 comprises two rings 21 and 22, which are axially locked by means of a central keyring. The ring 21 has teeth 23 on the radially outer side and is connected to the plate 18 for example by means of welding. The ring 22 is connected to the upper wall 2 of the cutter head. The ring 21 can be rotated vis-a-vis the ring 22 by means of pinion 10 engaging the teeth 23 and driven by a pivot motor 24 connected to the upper wall 2. Around the pivot bearing 20 and the pinion 10 extends a sealing 25. In FIG. 6 is indicated a housing 26 enclosing a drive motor and transmission for the drive shaft 1 and further ears 27 and 28 for connecting the cutter head to the ladder arm and a control ram respectively.

What is claimed is:

1. Rotary cutter head for a cutter dredger, which cutter head is provided with means for suspending said cutter head from a ladder arm of the dredger, means for connecting said cutter head to control ram means for performing pivot movements with the cutter head and means for connecting to said cutter head a mixture-suction conduit, said conduit having a branched lower end connected to two openings in a non-rotatable upper wall of the cutter head, wherein the cutter head is further provided with a ring of blades extending substantially in a cylindrical configuration, the lower ends of said blades being connected to a bottom plate, which by means of a central shaft extending through said upper wall, is rotatable in the direction of a suction mouth, which is positioned within the ring of blades in a radial plane through the axis of the ring of blades, wherein the suction mouth is connected to a plate provided with one passage only at the position of the suction mouth, which plate is rotatably mounted under the non-rotatable upper wall of the cutter head for positioning the opening in said plate and also the suction mouth alternatingly under each of the suction line connections in the upper wall of the cutter head, while closing off the other connection.

2. Rotary cutter head for a cutter dredger, said cutter head being provided with means for suspending said cutter head on a ladder arm of the dredger, means for connecting the cutter head to a control cylinder means for tilting movements of the cutter head and means for connecting a mixture-suction conduit, the cutter head being further provided with a rotatable ring of blades extending substantially in a cylindrical surface coaxial to the cutter head axis and a suction mouth which communicates with said suction conduit as well as a bottom plate at the lower end of the ring of blades, which bottom plate is rotatable for transferring soil loosened by said blades to the suction mouth, said suction mouth being positioned within the ring of blades with the entrance of the suction mouth substantially in a radial plane.

3. Rotary cutter head according to claim 2, wherein the ring of blades is connected to the bottom plate, the bottom plate is driven through a central shaft which extends through a non-rotatable upper wall of the cutter head and the suction mouth is connected to the suction line through a passage in the upper wall.

4. Rotary cutter head for a cutter dredger, provided with means for suspending the cutter head from a ladder arm of the dredger, means for connecting the cutter head with control ram means for performing tilting movements of the cutter head and means for connecting to the cutter head a suction line for mixture, which cutter head is further provided with a rotatable ring of blades extending substantially in a cylinder surface, the lower ends of the blades are connected with a bottom plate, which is rotatable by means of a central shaft extending through a non-rotatable upper wall of the cutter head, in which upper wall a passage is provided for connecting a suction mouth positioned within the ring of blades with a suction line extending from the cutter head for upward transport of mixture, wherein the suction mouth is positioned within the ring of blades in a scooping fashion, that is to say with the inlet opening of the mouth substantially in a radial plane through the axis of the ring of blades, which cutter head is further provided with an adaptor having the shape of a curved tube open at the ends and pivotable between a position wherein one tube end adjoins the suction mouth and a position spaced therefrom.

* * * * *